US007740548B2

(12) United States Patent
Lenard

(10) Patent No.: US 7,740,548 B2
(45) Date of Patent: Jun. 22, 2010

(54) BASKETBALL TRAINING APPARATUS

(76) Inventor: Anthony Lenard, 13609 Stettin Dr., Marathon, WI (US) 54448

( * ) Notice: Subject to any disclaimer, the term of this patent is extended or adjusted under 35 U.S.C. 154(b) by 0 days.

(21) Appl. No.: 12/254,070

(22) Filed: Oct. 20, 2008

(65) Prior Publication Data

US 2009/0143171 A1 Jun. 4, 2009

Related U.S. Application Data

(60) Provisional application No. 60/981,374, filed on Oct. 19, 2007.

(51) Int. Cl.
*A63B 69/00* (2006.01)
*A63B 63/08* (2006.01)

(52) U.S. Cl. ..... 473/449; 473/483

(58) Field of Classification Search ..... 473/447, 473/449, 483, 484
See application file for complete search history.

(56) References Cited

U.S. PATENT DOCUMENTS

| | | | | |
|---|---|---|---|---|
| 2,939,705 | A | 6/1960 | Mc Call Jr. | |
| 3,023,001 | A | 2/1962 | Gourdouze | |
| 3,173,687 | A | 3/1965 | Hair | |
| 3,348,840 | A | 10/1967 | Dix | |
| 3,910,574 | A | 10/1975 | Voltz et al. | |
| 4,161,313 | A | 7/1979 | Dickey | |
| 4,296,925 | A | 10/1981 | Alston | |
| 4,352,494 | A | 10/1982 | Wells | |
| 4,621,811 | A | 11/1986 | Campbell | |
| 4,643,422 | A * | 2/1987 | Cramblett | 473/483 |
| D352,321 | S | 11/1994 | Ivey | |
| 5,503,389 | A | 4/1996 | Campbell | |
| 5,916,046 | A | 6/1999 | Allred et al. | |
| 6,537,162 | B1 * | 3/2003 | Schroeder | 473/483 |
| 6,572,496 | B1 | 6/2003 | Brown | |
| 6,672,979 | B2 | 1/2004 | Brenneisen | |
| 6,773,365 | B2 | 8/2004 | Wilson | |
| 2004/0048695 | A1 | 3/2004 | Wilson | |
| 2004/0176192 | A1 | 9/2004 | Slavey et al. | |
| 2005/0085320 | A1 | 4/2005 | Joseph et al. | |
| 2007/0037638 | A1 * | 2/2007 | Rumfola, III | 473/433 |

FOREIGN PATENT DOCUMENTS

| | | |
|---|---|---|
| WO | WO9532033 | 11/1995 |

OTHER PUBLICATIONS

Hydra Rib McCall's Rebounder Basketball Rebound Trainer, world wide web.

* cited by examiner

*Primary Examiner*—Mark S Graham
(74) *Attorney, Agent, or Firm*—Lane Patents LLC

(57) ABSTRACT

The present invention relates to the sports training aids, in particular a improved apparatus for providing drills for new basketball players to practice rebounding skills, not having a platform or base below the players as they jump which can twist an ankle or knee. Further an improved mechanism for tuning the action in the recoil assembly is provided.

15 Claims, 5 Drawing Sheets

BASKETBALL TRAINING APPARATUS

FIELD OF THE INVENTION

The present invention relates to generally to sports training aids. In particular a basketball rebounding system for training basketball players to improve their rebounding skills.

BACKGROUND OF THE INVENTION

In basketball, it is important for the player to learn to aggressively and forcefully compete for missed shots which are rebounded from the rim or backboard.

US patent application publication US 2004/0176192 A1 by Slavey et al., discloses a portable basketball rebound apparatus having a plurality of pads situated on a plurality of adjustable arms that provide a toggle assembly. The apparatus is directed toward the player practicing "boxing out" before, during or after capturing a rebound. The rebounder has a rebounding arm or carriage having a carriage end, mounted on a pole extending from a base on the floor, for receiving and supporting a basketball a predetermined distance above the ground. The rebounding arm or carriage is pivotally secured by a pin and comprises a second end coupled to a solenoid which controls the motion of the rebounding arm downward during a rebound and the recovery once the ball is removed. A solenoid control of the type shown in Slavey cannot be independently controlled, or tuned, to match the both the desired resistance and rate of travel for return independently. Further solenoid designs of this type typically have a sharp increase in resistance when much force is applied such as a very aggressive rebound, which can result in unbalance and injury to a player. A pivoting stop has a first end coupled to a basketball track, which receives a plurality of basketballs through the top. The basketballs are retained and prevented from moving towards the carriage when rebounding arm or carriage is in the home position. As the rebounding aim or carriage is pulled or moved downward towards the ground, during a rebounding practice session, a second post rides along an inner surface of the pivoting stop which, in turn, causes the end to move, thus causing an indexing of the next basketball into position.

U.S. Pat. No. 2,939,705, issued to McCall, Jr., shows a basketball rebounding practice device that holds a plurality of basketballs and presents them in succession to a position where they can be taken by a player practicing rebounding. The device sits on the floor via a portable platform with casters, with a pedestal which extends from the platform and is adjustable in height, and has a basket-like receptacle. Balls drop in the basket area and then roll along a passageway and seat in the loop to be taken by players during practice.

Movement of the arm controls the feed of basketballs along the passageway. An arm is held against free downward swinging about its hinges by a check mechanism that includes pistons and springs in a cylinder that force the pistons back after movement. Using this check mechanism, the loop may be swung downwardly as a ball is taken, and the return movement will be slowed to prevent shock.

With both of the aforementioned inventions, having a base or platform on the floor can be problematic as players jockey for position under the rebound holding mechanism. Due to the inertial forces exerted pulling the ball down, the base or platform must be in close proximity to where a player may land in order to keep from tipping over. This can result in players landing on the base or platform and injuring ankles as they jockey for position.

U.S. Pat. No. 4,161,313, issued to Dickey, describes a basketball practice device allowing a player to practice handling a basketball in tipping a ball toward a basket. The device is directed toward a boom pivoted above a backboard, an extendible section depending from the boom in the vicinity of the goal on the backboard, and a cap for releasably holding a basketball carried at the lower end of the extendible section. The attachment by which the basketball is held to the cap can be varied to change the ease with which the ball is removed from the cap. This drill differs from the present invention in that the objective is to reach up to a ball that suspended in air in the vicinity of the basket and tipping the ball toward the basket.

SUMMARY OF THE INVENTION

It is an objective of the current invention to provide a training apparatus which can be mounted on a wall surface providing a floor free from obstruction below the basketball in the ball receiver.

It is a further objective of the current invention to provide a training apparatus which can be adjusted to a desired height.

It is a further objective to provide a training apparatus having a large receiving port for easily loading basketballs.

It is a further objective to provide a training apparatus having a storing capacity for a plurality of basketballs sufficient for extended drills.

It is a further objective to provide a training apparatus having a recoil assembly comprising self canceling actions for release and return by means of a recoil assembly and a rotational translator which rotate in counter directions.

It is a further objective to provide a training apparatus having a recoil assembly which can be tuned for release and return by means of a tensioner in the coupler assembly between the recoil assembly and the rotational translator.

It is a further objective to provide a training apparatus having a shock which minimizes the resistance during ball retrieval, yet has a pre-set resistance when the pivot arm assembly returns to the primary position for another ball to be retrieved.

BRIEF DESCRIPTION OF THE DRAWINGS

A complete understanding of the present invention may be obtained by reference to the accompanying drawings, when considered in conjunction with the subsequent, detailed description, in which.

REFERENCE NUMERALS IN DRAWINGS

1—basketball
10—training apparatus
12—mounting slide
13—hoisting means
14*a, b*—top and bottom lateral coupler
15—tie rod
16*a, b*—top and bottom diagonal coupler
17—vertical race
18—receiving port
19—tracks
20—vertical members
21—anchor
30—recoil assembly
32—axis
34—spring
36—lever arm
40—coupler assembly
42—proximal tie
44—tensioner
46—rod
48—distal tie
50—shock
52—proximal tie member
54—end
56—cylinder
58—piston
59—circlip
60—retaining member
61—washer
62—stop
63—bushing
64—end cap
65—port
66—rod
67—confluence
68—coupler
69—release
70—distal tie rod
73—secondary air chamber
74—air chamber
90—pivot arm assembly
92—ball receiver
94—hinge
96—lever
98—rotational translator
100—pivot arm axis
102—pivot arm tie

DESCRIPTION OF THE PREFERRED EMBODIMENT

Figure 1:
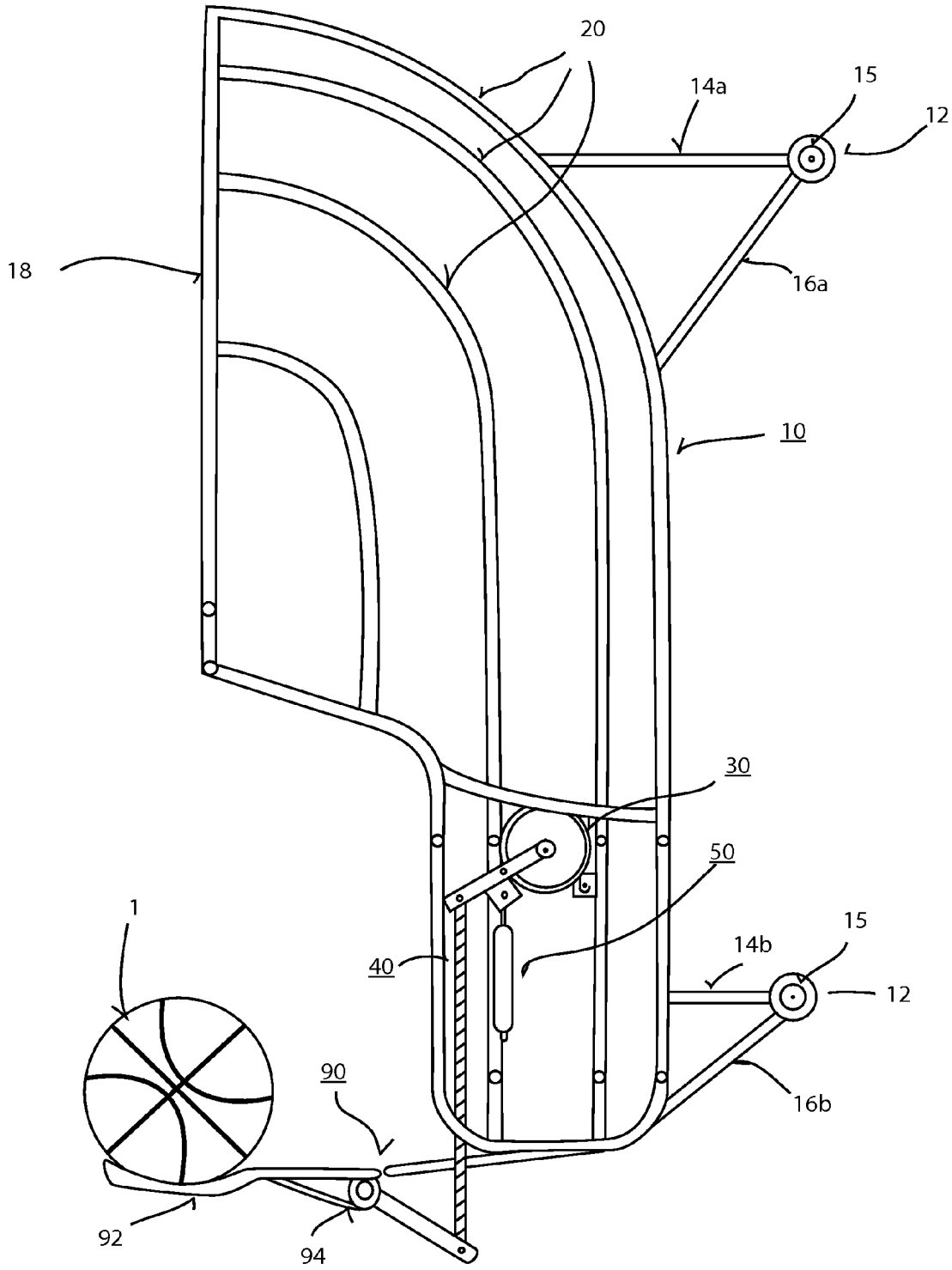
FIG. 1 shows a side view of a rebound training apparatus.
Figure 2:
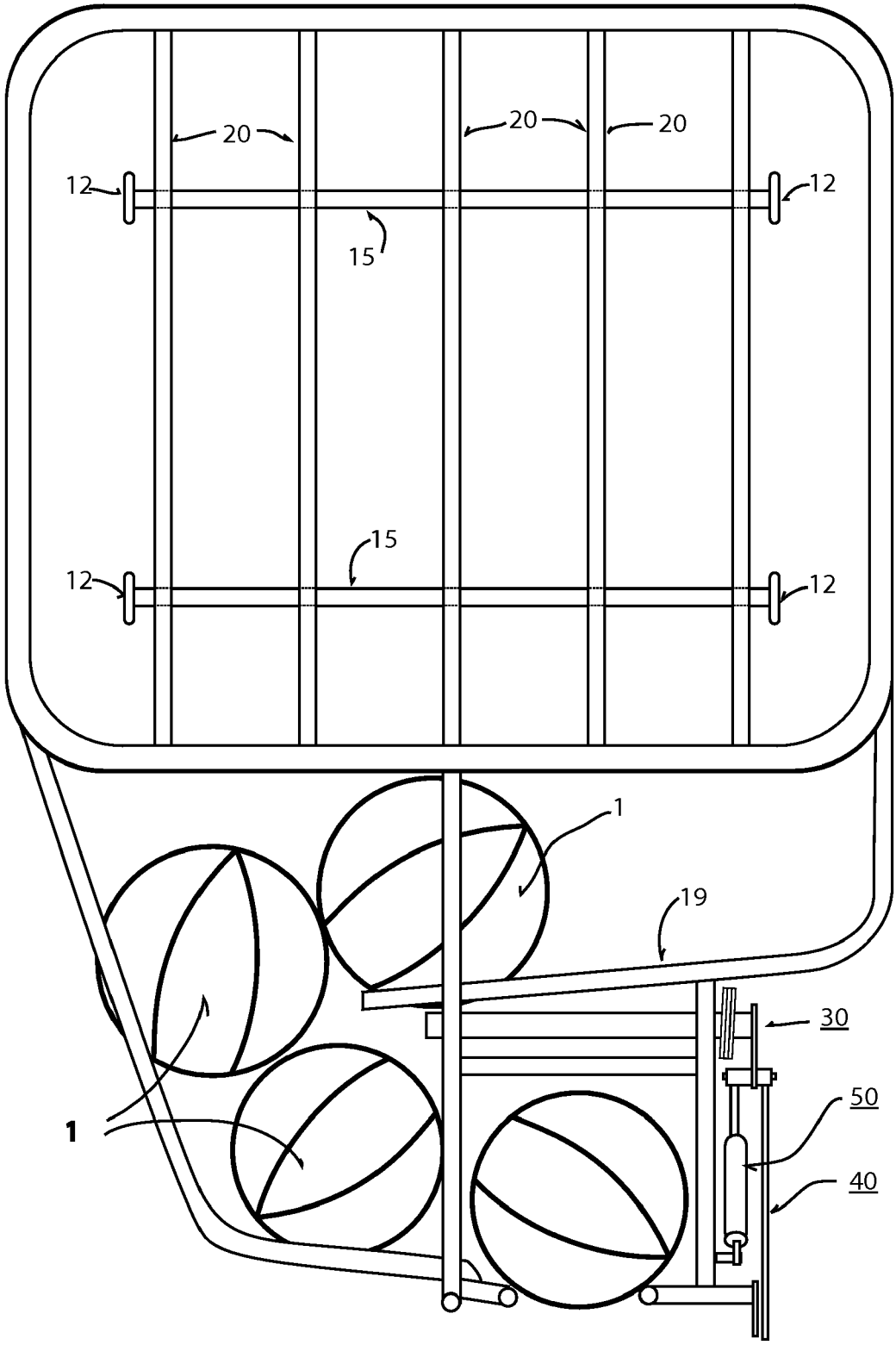
FIG. 2 shows a front view of the rebound training apparatus.

FIGS. 1 and 2 show some of the major features of the training apparatus 10. Basketballs 1 are fed into the training apparatus 10 by way of the receiving port 18, generally by tossing, where they then settle into a queue on tracks 19 located at the lower end of the training apparatus 10. The basketballs 1 move along a reciprocating path to the pivot arm assembly 90 where one ball at a time is presented to the ball receiver 92. In one configuration, as shown in FIGS. 1 and 2, as the player pulls the ball 1 from the ball receiver 92, a rotational force is applied to a lever 96 through a hinge 94, in a counter clockwise fashion, through a coupler assembly 40 and to lever arm 36 causing the recoil assembly 30 to rotate in a clockwise fashion working against a spring 34 (shown in FIG. 3). Also in communication with the recoil assembly is a shock 50 which serves to moderate resistance depending upon direction of rotation.

Figure 3:
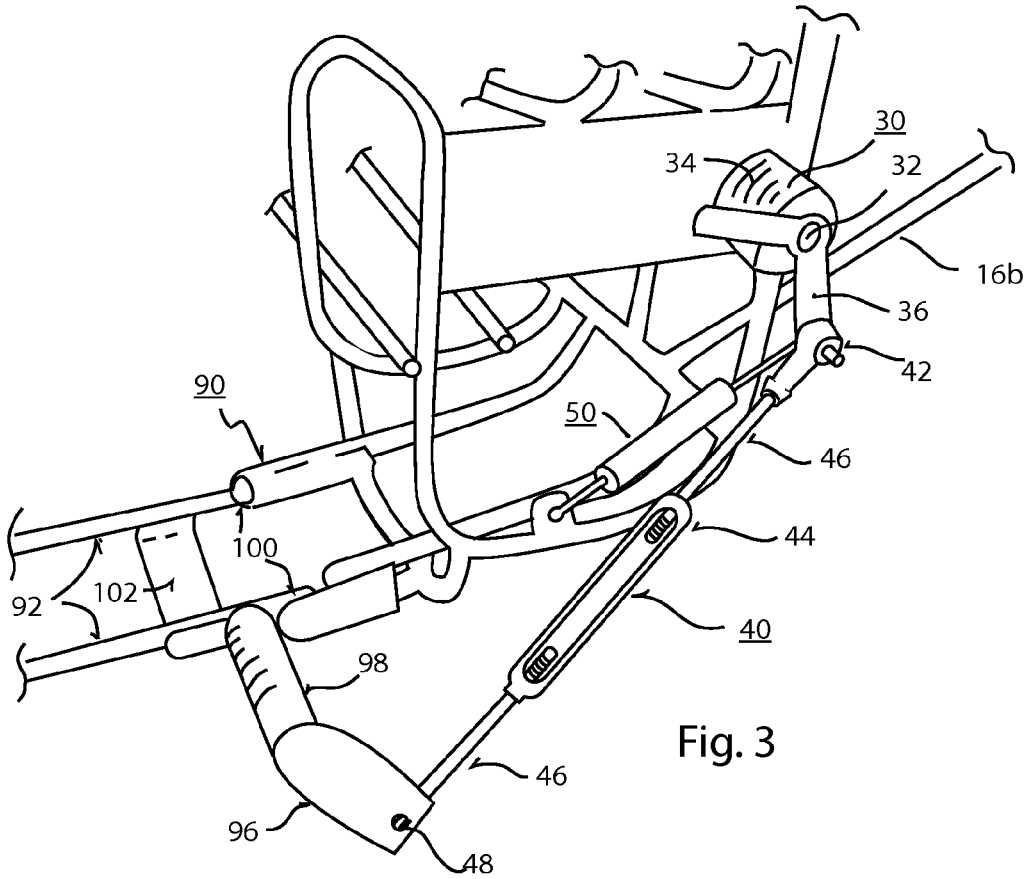
FIG. 3 shows a perspective view of one embodiment of a ball pivot arm assembly with recoil assembly and feed mechanism.

In a preferred embodiment of the recoil assembly as shown in FIG. 3, once a basketball 1 is located on end of the ball receiver 92 the player then attempts to remove the ball by means of grabbing the ball and pulling it down. The downward force of the ball 1 on the ball receiver 92, whose elements can be connected to act together by means of a pivot arm tie 102, causes a rotation of the pivot arm axis 100 and a rotational translator 98 to a lever 96 for controlling distance of travel and force to a coupler assembly 40 which is preferably comprised of at least one rod 46 being in communication between the lever 96 and the lever arm 36. The lever arm 36 is situated so as to translate the linear force from the coupler assembly back into a rotational force which acts upon a spring 34 which revolves around a fixed axis 32. The spring 34 applying a counter force designed to return the pivot arm assembly 90 to the primary position.

In order to enhance the skill of the player, the spring 34 may be coupled through the axis 32 to a lever arm 36 such that resistance is applied requiring the player to exert sufficient force to overcome the spring 34. In an alternate embodiment, the precise positioning and hence movement can be regulated by means of a coupler assembly 40 comprised of a tensioner 44 similar to those used in cable tensioning, such as a standard cable tensioner, so is to tune or regulate the length and, therefore, the coupling between the lever 96 and a lever arm 36. In addition, the lever arm is preferred to be coupled with the shock 50 positioned in parallel with the coupler assembly 40 to further control the relative rates of resistance and rotation of the pivot arm assembly 90.

Figure 4:
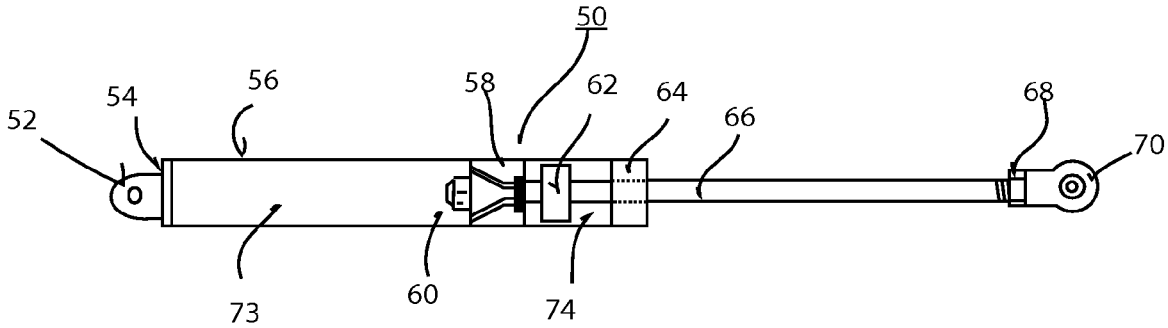
FIG. 4 shows a side through view of an embodiment of a shock cylinder in the extended position.
Figure 5:
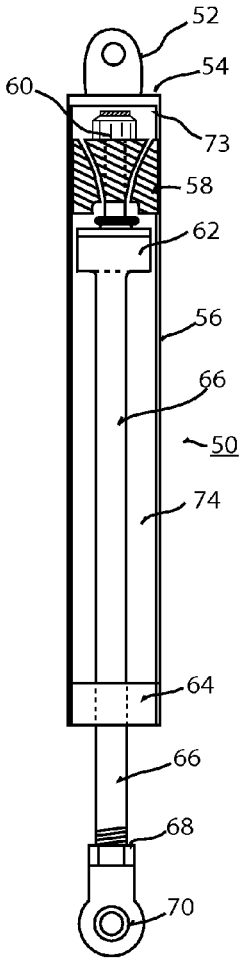
FIG. 5 shows a side through view of an embodiment of a shock cylinder in the compressed position.
Figure 6A:
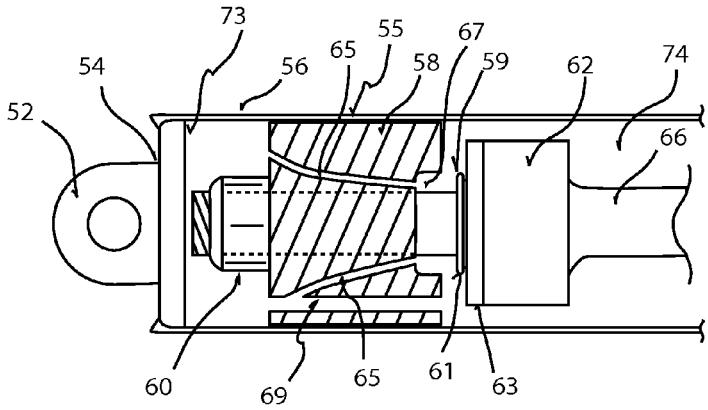
FIG. 6A shows a side through view of a close-up of an embodiment of a piston in the low resistance configuration.
Figure 6B:
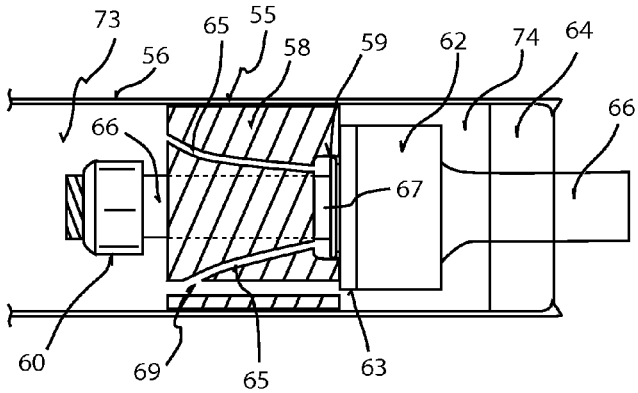
FIG. 6B shows a side through view of a close-up of an embodiment of a piston in the high resistance configuration.

Operation of the preferred embodiment of the shock 50 can best be understood by referring to FIGS. 4, 5, 6A and 6B, 7A and 7B. The shock 50 is designed such that there is negligible resistance during ball retrieval with a pre-set resistance when the pivot arm assembly returns to the primary position in time for another ball to be retrieved. The shock 50 is comprised of a proximal tie member 52 for mounting to the training apparatus 10 housing to the end 54. Coming orthogonally from the end 54 is a cylinder 56 which houses a piston 58 being mounted on a rod 66. The piston 58 is mounted to the rod 66 by means of a retaining member 60, which can be a simple nut and bolt combination or other suitable means. A stop 62 made of steel or other suitable material is located directly behind the piston such that during the elongation phase, when the shock is extending as shown in FIG. 6A, the rod 66 is able to move freely with little resistance. This because air entrained in the air chamber 74 is free to flow through the confluence 67, through at least one port 65 into the secondary air chamber 73 having little pressure drop.

Figure 7A:
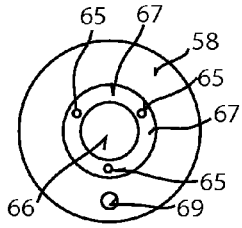
FIG. 7A shows a top view of one embodiment of the front side of a piston head.
Figure 7B:
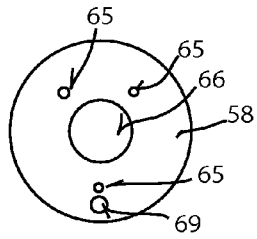
FIG. 7B shows a bottom view of one embodiment of the back side of a piston head.

As the piston moves from an extended position, FIG. 4, to a compressed position, FIG. 5, compression of air in the secondary air chamber 73 in addition to initial inertia of the rod 66 cause the piston 58 to move in the direction of the stop 62 causing the confluence 67 to be plugged by a washer 61 and bushing 63 building a more substantial pressure in the secondary air chamber 73. A release 69 can be located through the piston 58 which can be open, or partially blocked, between the air chamber and the secondary air chamber. The ratio of areas between ports 65 which terminate in the confluence 67, and the port 69 which terminates outside the confluence 67, as shown in FIGS. 7A and 7B, can be adjusted by one skilled in the art to optimize the resistance between extension and compression. Those skilled in the art will appreciate that the mechanism herein disclosed can also be design in reciprocal fashion without departing from the spirit of the invention.

Figure 8:
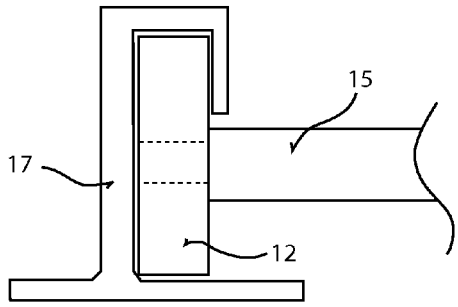
FIG. 8 shows a top down representative view of one embodiment of a mounting slide mounted in a vertical race.
Figure 9:
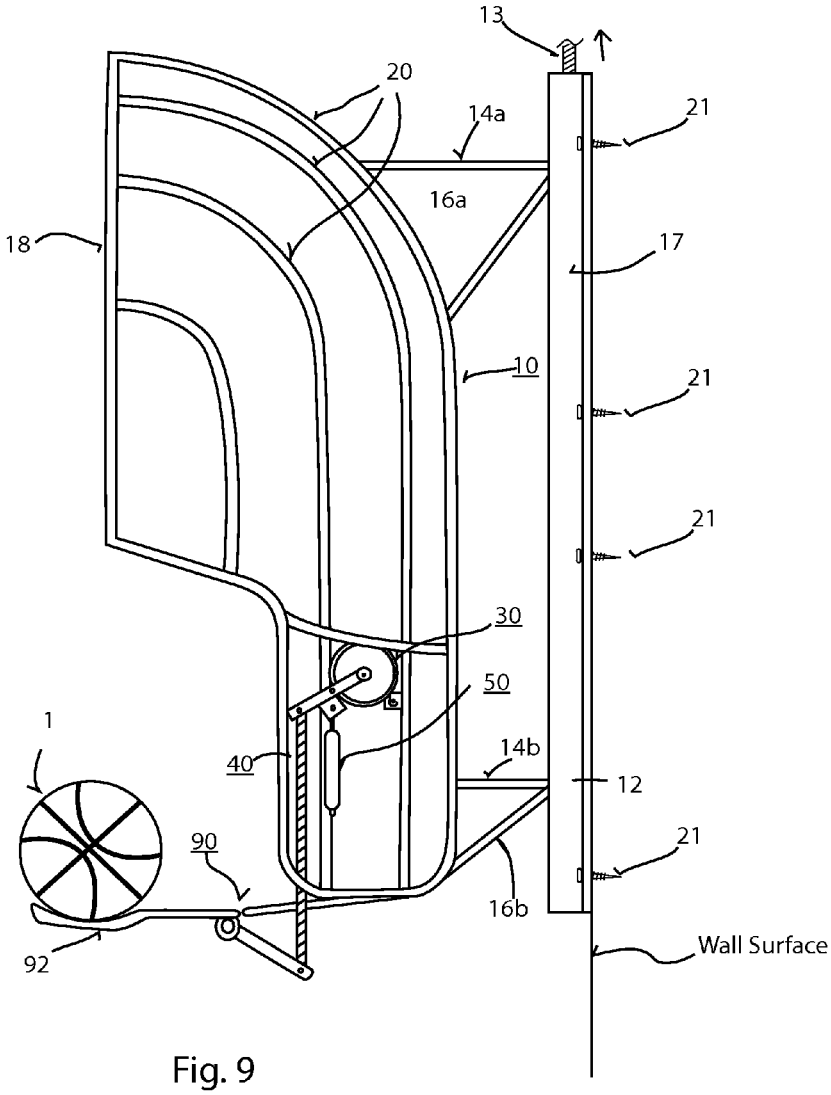
FIG. 9 shows a side view of one embodiment of a rebound training apparatus mounted to a wall.

FIGS. 8 and 9 show a preferred way in which the training apparatus 10 can be mounted to a wall by means of vertical races 17 which are attached in parallel to a wall in a substantially vertical position. The races are placed at a distance which corresponds to the mounting slides 12, shown in FIGS. 1 and 2, to allow the mounting slides 12 to fit into the vertical races 17 as shown in FIG. 8. The mounting slides 12, which may be comprised of a wheel, low friction slide or other like means, are connected to the apparatus 10 by means of a tie rod 15 extending generally horizontally from the vertical races 17 and are connected to the vertical members 20 of the training apparatus 10 by means of the top and bottom lateral coupler 14*a* and 14*b* and the top and bottom diagonal coupler 16*a* and 16*b* shown in FIGS. 1 and 2.

The height can be adjusted as desired, by means of a hoisting means 13, which is typically a cable and pulley, but can comprise a ratcheting means, gear, drive motor drive or the like sufficient to move the training apparatus 10 along the vertical races 17 to the desired above the playing floor. It is desired that the height take into account a vertical distance which will challenge the player.

CONCLUSION, RAMIFICATIONS, AND SCOPE

Although the present invention has been described in detail, those skilled in the art will understand that various changes, substitutions, and alterations herein may be made without departing from the spirit and scope of the invention in its broadest form. The invention is not considered limited to the example chosen for purposes of disclosure, and covers all changes and modifications which do not constitute departures from the true spirit and scope of this invention.

Having thus described the invention, what is desired to be protected by Letters Patent is presented in the subsequent appended claims.

What is claimed is:

1. A training apparatus for practicing basketball drills comprising:

(i) means for receiving basketballs being mounted on a wall surface in a substantially overhead position above a playing floor;

(ii) means for arranging and moving basketballs from receiving means in a substantially orderly manner;

(iii) means for positioning basketballs from arranging means substantially above a player, said positioning means being operatively coupled with said means for arranging and moving basketballs;

(iv) a recoil assembly, having a primary and a secondary position, being operatively coupled with a shock for controlling movement of said recoil assembly said shock comprising:

a cylinder being fitted with a piston such that said piston substantially fills the cross sectional area of the cylinder, said piston being slidably attached to a rod;

said piston further having a top side and a bottom side being separated by a middle portion, the top side further comprising a confluence being substantially void and of predetermined form;

the piston having at least one port for moving air between the top side and the bottom side;

wherein at least one of said ports terminates in the confluence, said rod being operatively coupled with a bushing such that the bushing blocks the movement of air when the piston travels in a predetermined direction;

(v) such that when a basketball, positioned by said recoil assembly being in said primary position, is grabbed by the player said recoil assembly moves to said secondary position thus releasing the basketball when a predetermined amount of force is supplied;

(vi) means for returning said recoil assembly to the primary position.

2. The apparatus in accordance with claim 1 wherein the distance between the apparatus and the playing floor can be adjusted.

3. The apparatus in accordance with claim 2 wherein the adjustment means comprises a plurality of vertical races attached to the wall being movably coupled with a plurality of mounting slides, each mounting slide being securely connected with at least one coupler extending from the apparatus.

4. The apparatus in accordance with claim 3 wherein the plurality of vertical races are positioned substantially in parallel with regard to one another, further being coordinated in such a way that each vertical race can receive a plurality of couplers.

5. The apparatus in accordance with claim 3 wherein the distance between the apparatus and the playing floor can be fixed at predetermined distances.

6. The apparatus in accordance with claim 1 wherein the means for receiving basketballs comprises a large receiving port for easily loading basketballs.

7. The apparatus in accordance with claim 1 wherein means for arranging and moving basketballs comprises a storing capacity for a plurality of basketballs sufficient for extended drills.

8. The apparatus in accordance with claim 1 wherein the recoil assembly is in communication with a rotational translator by means of a coupler.

9. The apparatus in accordance with claim 1 wherein the recoil assembly and the rotational translator rotate in counter directions.

10. The apparatus in accordance with claim 8 wherein the coupler further comprises a tensioner.

11. The apparatus in accordance with claim 8 wherein the piston further comprises a release for moving air between the top side the bottom wherein the release terminates outside the confluence.

12. A training apparatus for practicing basketball drills having a shock assembly having minimal resistance in one direction of travel with a pre-set resistance when traveling in another direction, comprising;

(i) a ball receiver and means for delivering basketballs to the ball receiver positioned substantially above a player;

(ii) the ball receiver having at least one end coupled with a hinge; said hinge attached to a lever adapted toward receiving the rotational force applied to said hinge;

(iii) a spring being operatively coupled with said hinge for forming a recoil assembly;

(iv) a shock, which serves to moderate resistance depending upon direction of rotation;

(v) said shock comprising;

(vi) a proximal tie member attached to an end and adapted for mounting the shock to a training apparatus housing;

(vii) coming substantially orthogonally from the end is a cylinder which houses a piston;

(viii) the piston being mounted on a rod, and arranged so as to divide the cylinder into an air chamber and a secondary air chamber and having at least one port for moving air between said chambers;

(ix) a stop being slidably mounted behind the piston, such that when the piston is being extended, air moves freely between said chambers allowing the rod to move with little resistance;

(x) as the piston is being compressed, the stop being designed to block at least one port thus increasing resistance of air flow between said chambers, causing the rod to move with greater resistance.

13. The apparatus in accordance with claim 12 wherein the recoil assembly is in communication with the shock by means of a coupler.

14. The apparatus in accordance with claim 13 wherein the coupler further comprises a tensioner.

15. The apparatus in accordance with claim 14 wherein the tensioner is adjustable to further adjust the resistance according to rotational force.

* * * * *